US008294116B2

(12) United States Patent
Jiang et al.

(10) Patent No.: US 8,294,116 B2
(45) Date of Patent: Oct. 23, 2012

(54) PHOTOCATHODE WITH NANOMEMBRANE

(75) Inventors: Nan Jiang, Austin, TX (US); Richard Lee Fink, Austin, TX (US)

(73) Assignee: Applied Nanotech Holdings, Inc., Austin, TX (US)

( * ) Notice: Subject to any disclaimer, the term of this patent is extended or adjusted under 35 U.S.C. 154(b) by 602 days.

(21) Appl. No.: 12/557,792

(22) Filed: Sep. 11, 2009

(65) Prior Publication Data

US 2010/0102245 A1 Apr. 29, 2010

Related U.S. Application Data

(60) Provisional application No. 61/096,113, filed on Sep. 11, 2008.

(51) Int. Cl.
*H01J 3/14* (2006.01)

(52) U.S. Cl. ..... 250/396 R; 250/491.1; 250/492.3; 250/493.1; 250/505.1; 977/950; 977/949; 977/932; 977/902; 977/742

(58) Field of Classification Search ..... 250/396 R, 250/492.1, 492.3, 493.1, 505.1; 977/950, 977/949, 932, 902, 742
See application file for complete search history.

(56) References Cited

U.S. PATENT DOCUMENTS

| | | | | |
|---|---|---|---|---|
| 6,534,798 | B1 * | 3/2003 | Scherer et al. | 257/98 |
| 7,279,686 | B2 * | 10/2007 | Schneiker | 250/396 R |
| 2008/0061700 | A1 * | 3/2008 | Blick | 315/5 |
| 2008/0296537 | A1 * | 12/2008 | Gordon et al. | 252/506 |

* cited by examiner

*Primary Examiner* — Michael Logie
(74) *Attorney, Agent, or Firm* — Kelly Kordzik; Matheson Keys Garsson & Kordzik PLLC

(57) ABSTRACT

Optical beam modulation is accomplished with the aid of a semiconductive nanomembrane, such as a silicon nanomembrane. A photocathode modulates a beam of charged particles that flow between the carbon nanotube emitter and the anode. A light source, or other source of electromagnetic radiation, supplies electromagnetic radiation that modulates the beam of charged particles. The beam of charged particles may be electrons, ions, or other charged particles. The electromagnetic radiation penetrates a silicon dioxide layer to reach the nanomembrane and varies the amount of available charge carriers within the nanomembrane, thereby changing the resistance of the nanomembrane. As the resistance of the nanomembrane changes, the amount of current flowing through the beam may also change.

8 Claims, 8 Drawing Sheets

PHOTOCATHODE WITH NANOMEMBRANE

CROSS-REFERENCE TO RELATED APPLICATIONS

This application claims priority to U.S. Provisional Application Ser. No. 61/096,113.

TECHNICAL FIELD

This disclosure relates to modulating a beam of charged particles with electromagnetic radiation.

BACKGROUND INFORMATION

In a variety of electronic systems, it is useful to modulate a beam of charged particles, such as electrons or ions. Electron beams are employed in heating systems, imaging systems, display systems, and high-frequency (e.g., radio frequency) signal processing. Examples of systems employing ion beams include neutron generators, which may be used to detect nuclear materials, explosives, landmines, drugs, or other contraband, and which may have industrial applications, such as qualifying coal streams, cement, or other commodity items. In these systems, as well as others, the flow of charged particles may be modulated, e.g., turned on, turned off, increased, decreased, or cycled at some frequency.

In particular, it may be useful to modulate the beam of charged particles with an electromagnetic radiation source, e.g. a light source, such as a laser. Electromagnetic radiation may convey signals with a relatively high frequency, and in some instances, these signals may be transmitted between electrically isolated components.

DETAILED DESCRIPTION

Figure 1:
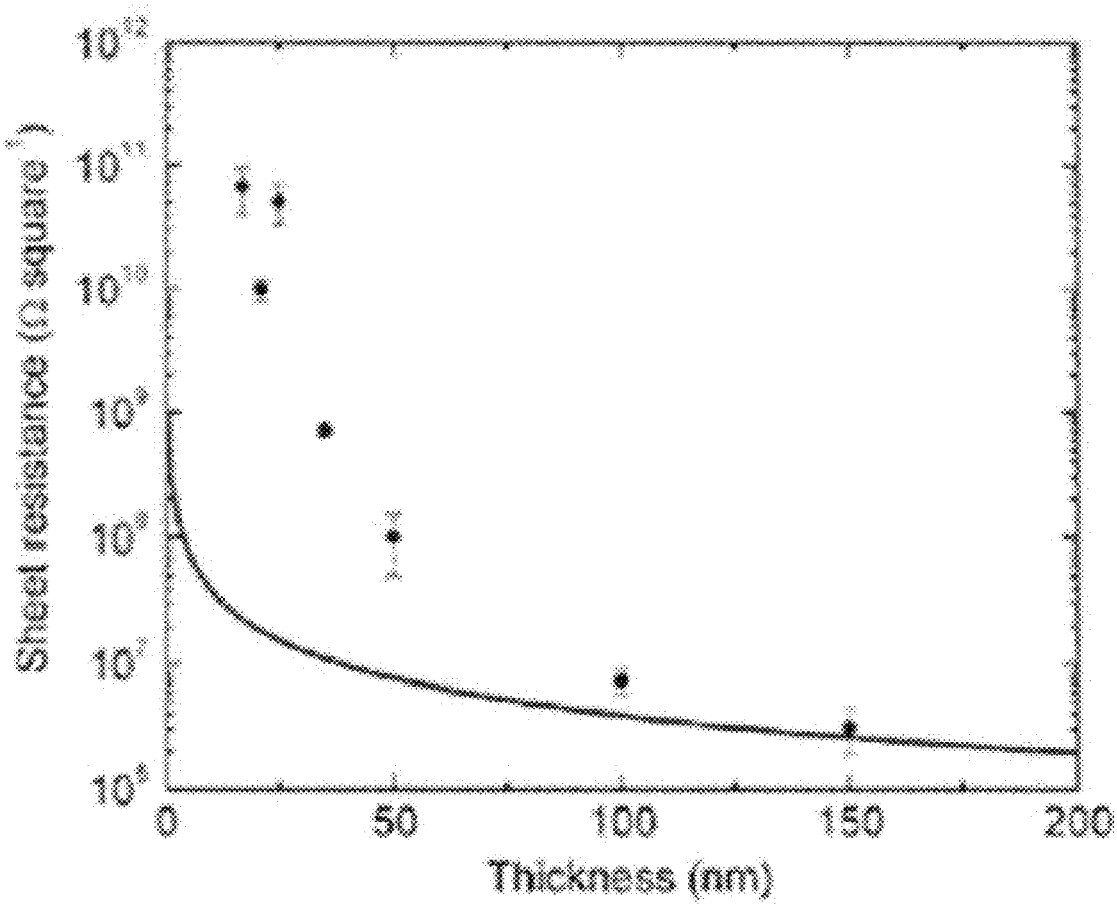
FIG. 1 illustrates a graph of sheet resistance of a silicon nanomembrane on an isolated silicon-on-insulator substrate.

As explained below, optical beam modulation may be accomplished with the aid of a semiconductive nanomembrane, such as a silicon nanomembrane. A silicon nanomembrane ("SiNM") is a kind of semiconductor with a band gap around 1 eV, which is similar to bulk silicon. It is, however, different from bulk silicon in that its conductivity significantly varies with thickness. As illustrated in the graph in FIG. 1, the sheet resistance of a SiNM on isolated $SiO_2$ (e.g., on a silicon-on-insulator substrate "SOI substrate") increases sharply as the thickness of the silicon nanomembrane is reduced. This effect may be due to carrier depletion. When the membrane thickness is less than 100 nm, the sheet resistance can reach as high as $10^7$ to $10^{11}\Omega$/unit of square area. Such a high resistance is about equivalent to, or larger than, the typical working impedance of carbon nanotube (CNT) field emission devices (e.g., in devices operating near a kV at sub mA or mA regime, or around $10^7\Omega$ impedance).

Silicon nanomembranes are electrically responsive to electromagnetic radiation. As a semiconductor with a relatively narrow band gap, a SiNM's resistance is adjustable by visible light illumination or infrared (IR) light illumination. And, its ultra-thin thickness, absence of defects, and single crystalline characteristics are believed to provide a relatively fast photoresponse and relatively high sensitivity to light.

By exploiting these properties, semiconductive nanomembranes can be used to modulate a beam of charged particles with electromagnetic radiation, e.g., in a photocathode. Examples of such embodiments are described below: an off-chip CNT/SiNM photocathode, an on-chip CNT/SiNM photocathode, and a photocathode formed on a glass substrate. In some embodiments, these devices may generate high-frequency modulated electron beams that are optically controlled. Note that the present invention is not limited to these specific embodiments.

Figure 2:
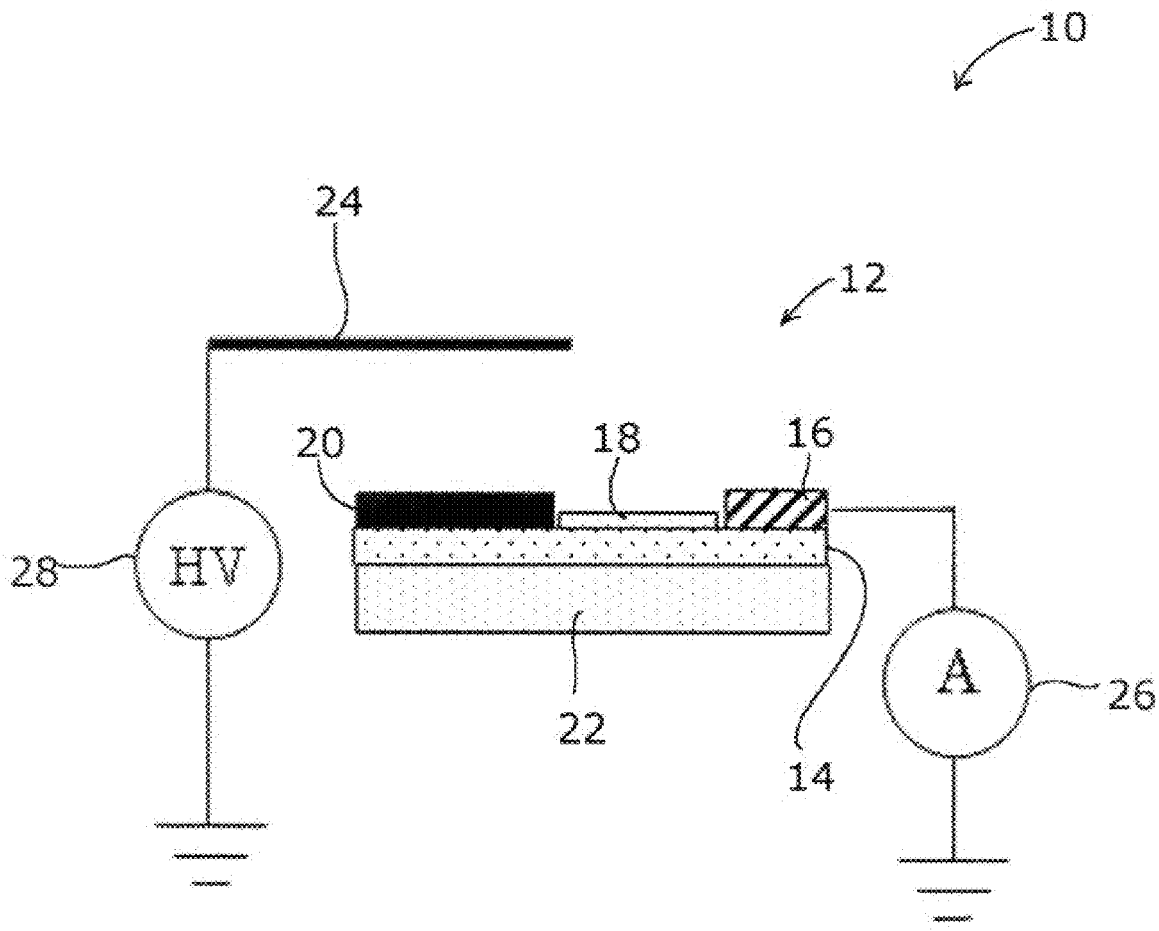
FIG. 2 illustrates a photocathode system.

FIG. 2 illustrates a system 10 having a photocathode 12. The system 10 may be part of an imaging system, such as a radar system, a medical imaging system (e.g., an x-ray system), a terrestrial or satellite-based communications system, a heating system (e.g., a microwave oven), an electron accelerator, a particle accelerator, a neutron generator, or any system utilizing an electron beam source. For instance, the photocathode 12 may be an electron beam source in a traveling wave tube, a klystron, a magnetron, or other microwave amplifier, microwave device, or x-ray device.

The illustrated photocathode 12 includes a nanomembrane 14, an electrode 16, a silicon dioxide layer 18, a carbon nanotube emitter 20, and a substrate 22, and it may be in electrical communication with an anode 24, a current source 26, and a voltage source 28. The nanomembrane 14 may be a semiconductive material having a thickness less than about 200 nm, or more preferably about 150 nm, or more preferably about 100 nm, or more preferably about 50 nm. The nanomembrane 14 may include or consist essentially of silicon, e.g., single-crystal silicon, or other semiconductive materials. The electrode 16 may include a conductive material, such as aluminum or an aluminum alloy, and may include various liner materials. The silicon dioxide layer 18 may be deposited or grown, e.g., as a native oxide. The carbon nanotube emitter 20 may include carbon nanotubes deposited or grown on the nanomembrane 14. The substrate 22 may include a dielectric material, such as silicon oxide, formed on a silicon wafer or other substrate material, and the photocathode 12 may be formed on the dielectric material.

Figure 3:
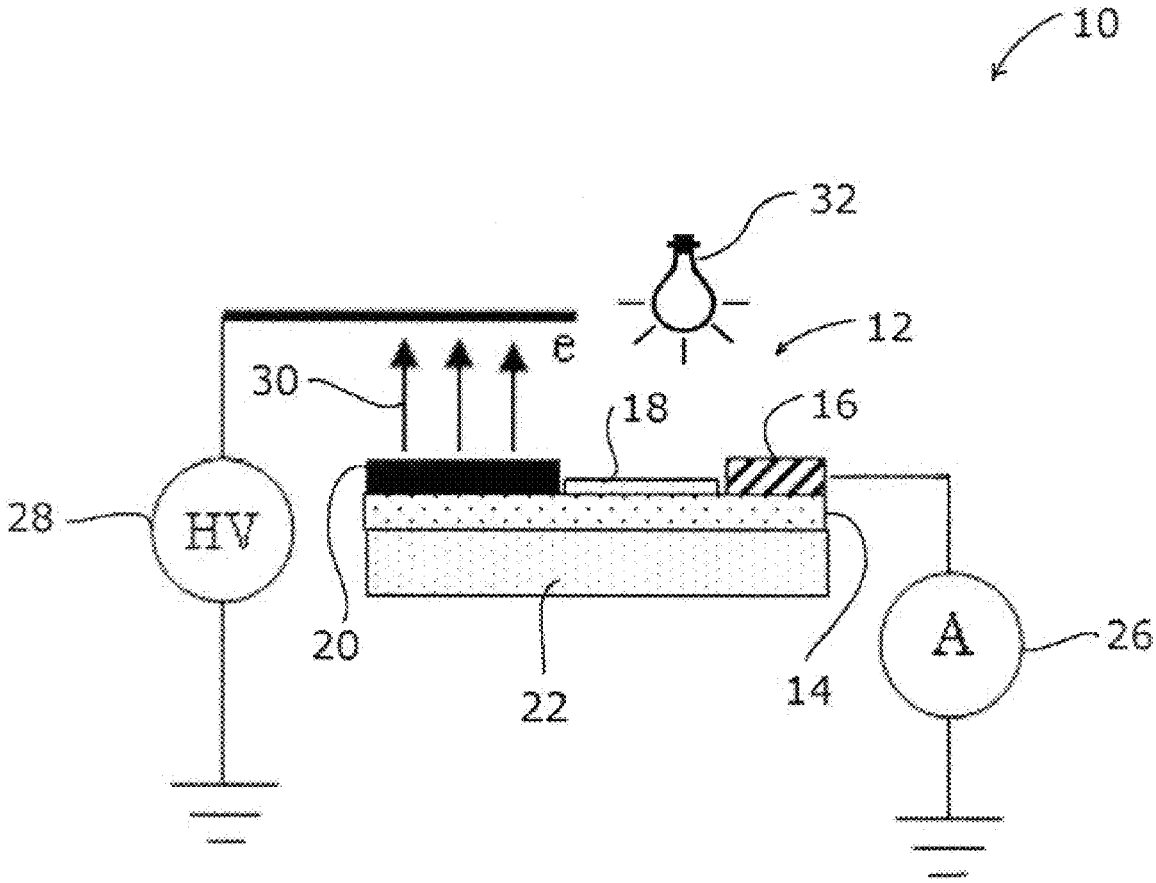
FIG. 3 illustrates operation of the photocathode system.

In operation, the photocathode 12 modulates a beam of charged particles 30 that flow between the carbon nanotube emitter 20 and the anode 24, as illustrated by FIG. 3. A light source, or other source of electromagnetic radiation 32, supplies electromagnetic radiation that modulates the beam of charged particles 30. The beam of charged particles 30 may be electrons, ions, or other charged particles. The source of electromagnetic radiation 32 may be a laser, a light-emitting diode, ambient light, or other source. Electromagnetic radiation from the electromagnetic radiation source 32 penetrates the silicon dioxide layer 18 to reach the nanomembrane 14 and varies the amount of available charge carriers within the nanomembrane 14, thereby changing the resistance of the nanomembrane 14. As the resistance of the nanomembrane 14 changes, the amount of current flowing through the beam 30 may also change. Thus, the beam of charged particles 30 may be controlled by the source of electromagnetic radiation 32.

The photocathode 12 illustrated by FIGS. 2 and 3 may be characterized as an off-chip type photocathode, as the beam of charged particles 30 travels to an anode 24 that is separate from the substrate 22.

Figure 4:
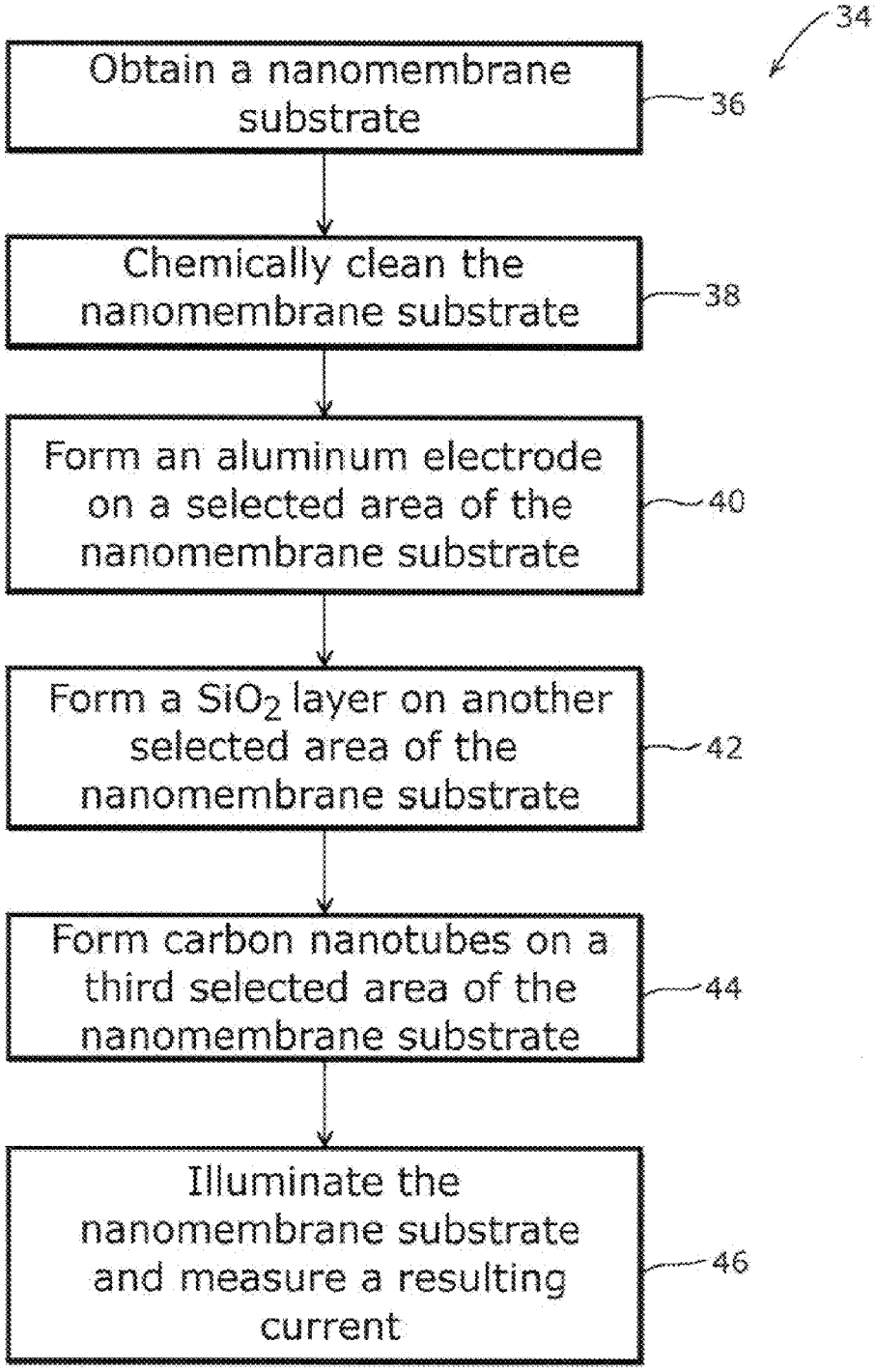
FIG. 4 illustrates a process for manufacturing a photocathode.

FIG. 4 illustrates an embodiment of a process 34 for making an of type photocathode, such as described above. The process 34 may begin with obtaining a nanomembrane substrate, as illustrated by block 36. Obtaining a nanomembrane substrate may include purchasing a nanomembrane substrate or manufacturing a nanomembrane substrate, such as a silicon-on-insulator substrate having an appropriate silicon thickness. Next, the nanomembrane substrate may be chemically cleaned, as illustrated by block 38, and an aluminum electrode may be formed on a selected area of the nanomembrane substrate, as illustrated by block 40. Forming an aluminum electrode may include depositing, e.g., with physical vapor deposition, a layer of aluminum on the nanomembrane substrate, and patterning the resulting aluminum film with lithography (e.g., photolithography) and etching. A silicon dioxide layer may be formed on the nanomembrane substrate, as illustrated by block 42, by depositing and patterning silicon dioxide or by growing a native oxide layer in exposed areas. Next, carbon nanotubes may be deposited or gown on a third selected area of the nanomembrane substrate, as illustrated by block 44. To test the photocathode produced by these steps, the nanomembrane substrate may be illuminated, and a resulting current may be measured, as illustrated by block 46.

Figure 5:
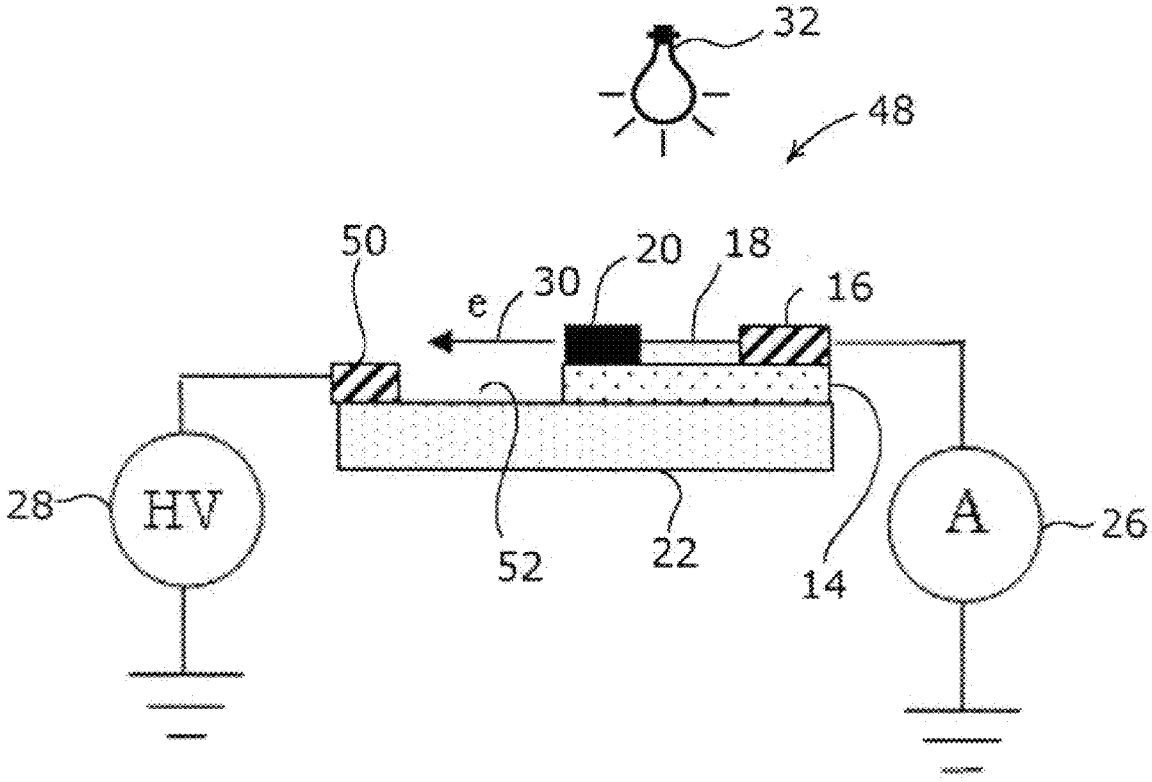
FIG. 5 illustrates an on-chip photocathode.

FIG. 5 illustrates an embodiment of an on-chip photocathode 48. In this embodiment, an anode 50 is formed on a substrate 22. The anode 50 may be formed in an exposed region 52 of the substrate 22 in which a nanomembrane 14 has been thinned or removed. In operation, a beam of charged particles 30 travels across the substrate 22, between the carbon nanotube emitter 20 and the anode 50.

Figure 6:
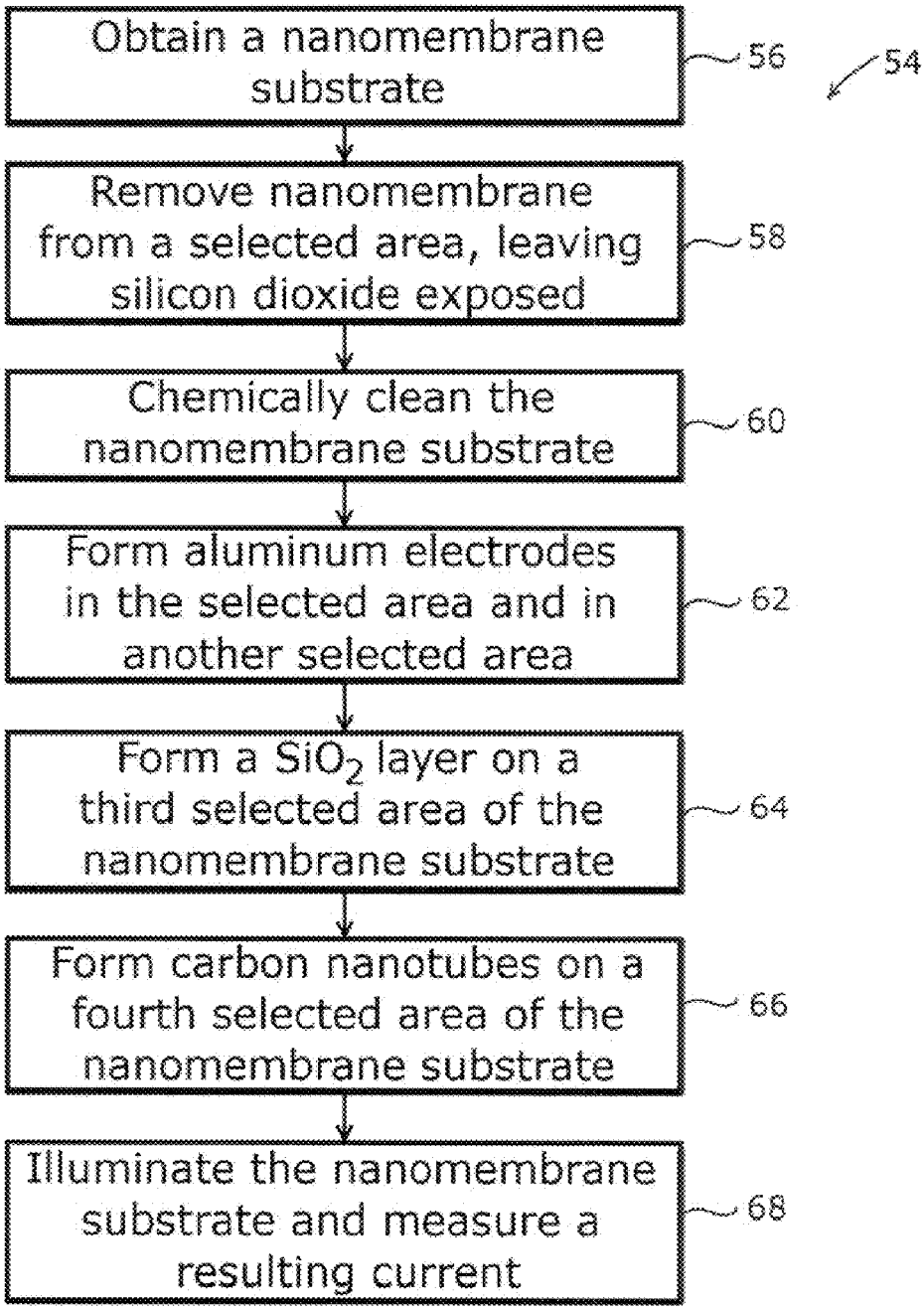
FIG. 6 illustrates a process for manufacturing the on-chip photocathode.

The on-chip photocathode 48 may be formed with a process 54 illustrated in FIG. 6. The process 54 may begin with obtaining a nanomembrane substrate, as illustrated by block 56, and removing the nanomembrane from a selected area, as illustrated by block 58. The nanomembrane may be removed from the selected area by patterning the substrate with photolithography and etching the nanomembrane from the selected area to leave silicon dioxide exposed. For instance, the nanomembrane may be etched with a chemical etch. Next, the nanomembrane substrate may be chemically cleaned, as illustrated by block 60, and aluminum electrodes may be formed both in the above-mentioned selected area and in another selected area, as illustrated by block 62. In some embodiments, this step may form both the anode and the electrode that connects to the carbon nanotube emitter. A layer of silicon dioxide may be formed or gown on a third selected area of the nanomembrane substrate, as illustrated by block 64, and carbon nanotubes may be formed (e.g., deposited or grown) on a fourth selected area of the nanomembrane substrate, as illustrated by block 66. Finally, the nanomembrane substrate may be tested by illuminating the nanomembrane substrate and measuring a resulting current, as illustrated by block 68.

Figure 7:
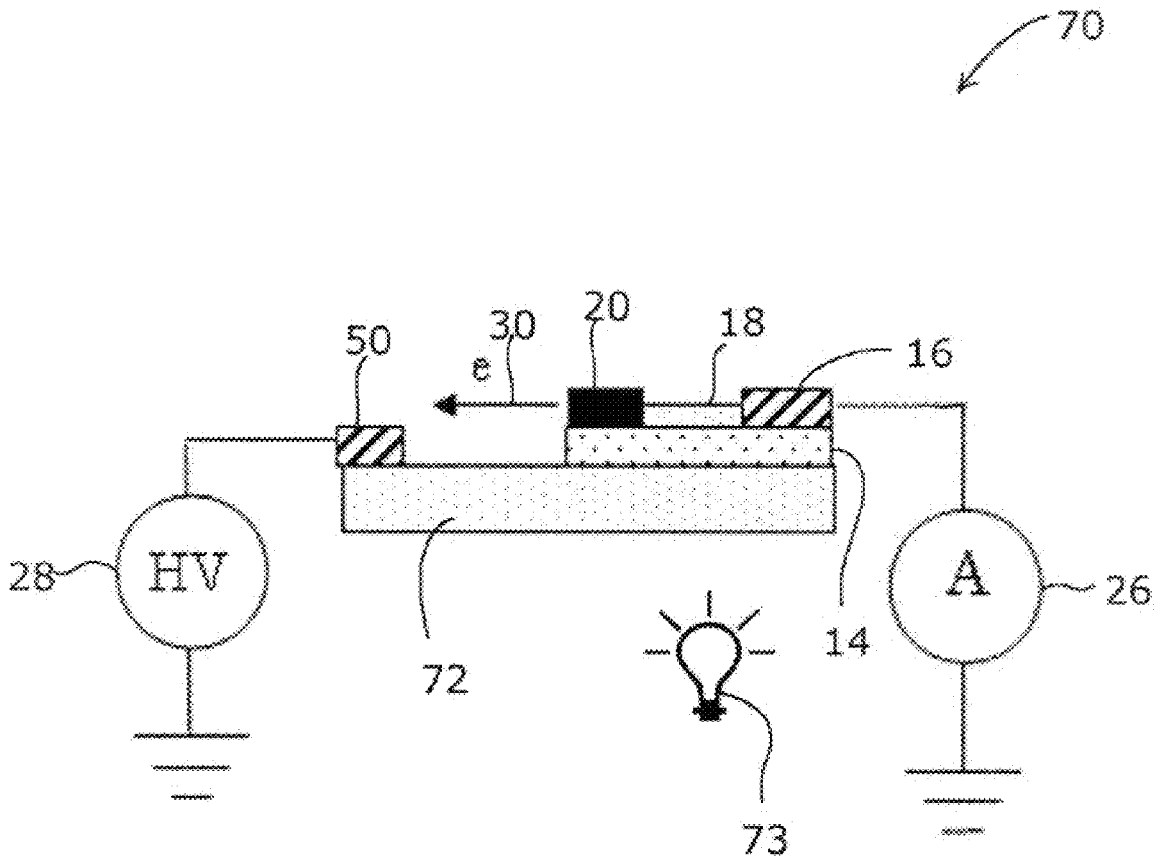
FIG. 7 illustrates a photocathode formed on a glass substrate.

FIG. 7 illustrates an embodiment of a photocathode 70 that may be formed on a glass substrate 72 (or an equivalent substrate transparent to the utilized electromagnetic radiation from the source 73). An electromagnetic radiation source 73 may be communicatively coupled to the photocathode 70 through the glass substrate 72. For instance, an optical fiber may be bound to the back surface of the glass substrate 72, and light may be transmitted through the glass substrate 72 to the nanomembrane 14. The remainder of the photocathode 70 operates similarly as the photocathode 48.

Figure 8:
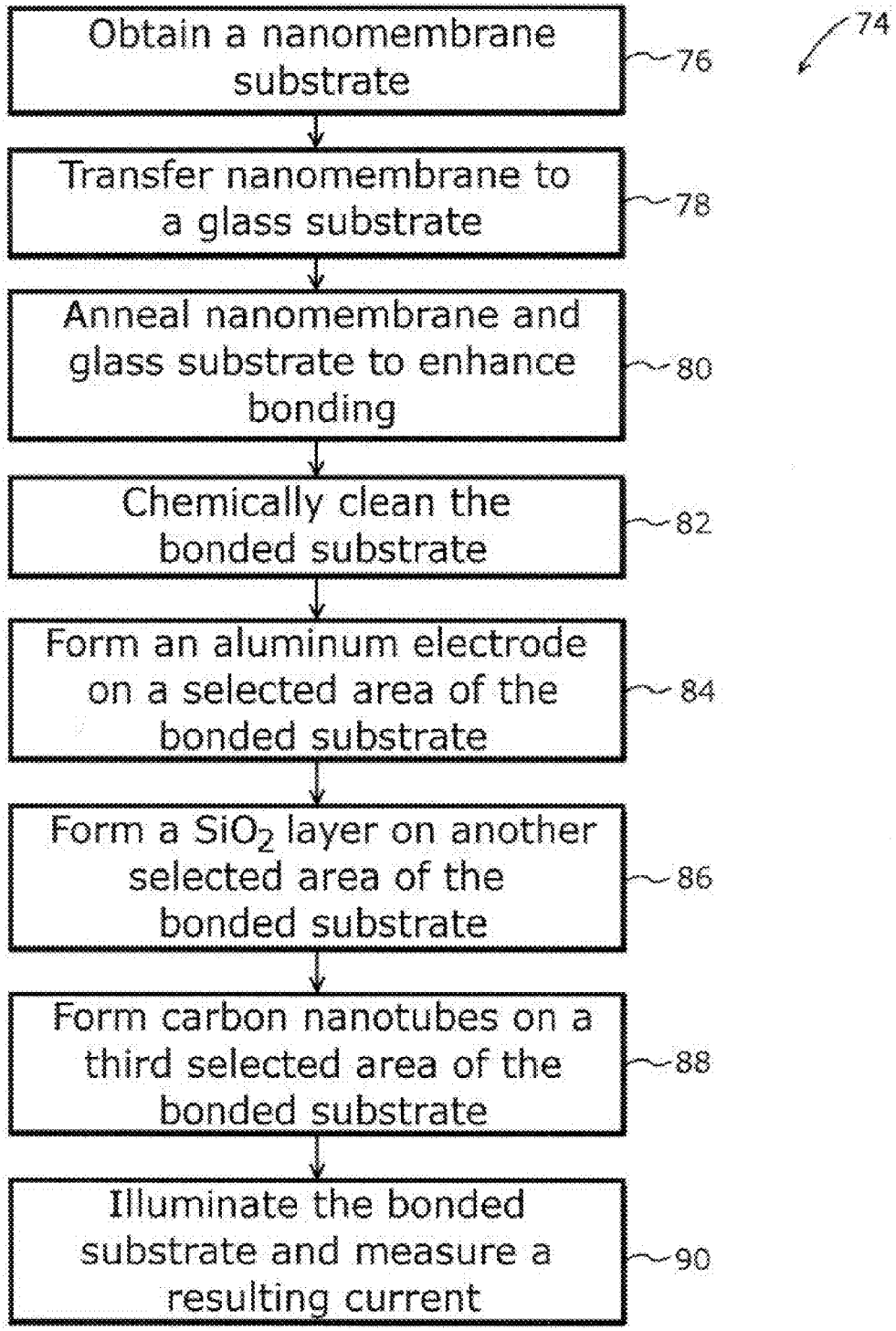
FIG. 8 illustrates a process for manufacturing the photocathode of FIG. 7.

The photocathode 70 may be formed with a process 74 illustrated in FIG. 8. The process 74 may include obtaining a nanomembrane substrate, as illustrated by block 76, and transferring the nanomembrane to a glass-substrate, as illustrated by block 78. Transferring the nanomembrane may include lifting the nanomembrane from the nanomembrane substrate, e.g., by cleaving the nanomembrane. Next, the nanomembrane and glass substrate may be annealed to enhance bonding between the nanomembrane and the glass substrate, as illustrated by block 80. The resulting bonded substrate may then be chemically cleaned, as illustrated by block 82, and an aluminum electrode may be formed on a selected area of the bonded substrate, as illustrated by block 84. Next, a silicon dioxide layer may be formed in another selected area of the bonded substrate, as illustrated by block 86, and carbon nanotubes may be formed on a third selected area of the bonded substrate, as illustrated by block 88. Finally, the photocathode yielded by the process 74 may be tested by illuminating the bonded substrate and measuring a resulting current, as illustrated by block 90.

In some embodiments, the previously described photocathodes may include electrodes configured to further enhance the response and the sensitivity of the photocathodes. For example, the electrodes in one or more of the previously described embodiments may have a comb-like shape or other shape designed to increase responsiveness or sensitivity. It should also be noted that while the previously described embodiments show the beam of charged particles flowing toward the voltage source, in other embodiments, the polarity of the voltage source may be reversed, and the previously described devices may be used to form optically modulated ion beams. Such ion beams made be used in a variety of systems, such as a high-frequency ionizer or a neutron generator.

In other embodiments, the anode (24 in FIGS. 2 and 3; 50 in FIGS. 5 and 7) may be a screen, grid, or a perforated conducting electrode that allows part of the electron or ion beam to pass through and be acted on by electric fields imposed by other electrodes, such as focusing electrodes or high voltage targets, as in the case of x-ray sources or neutron sources.

What is claimed is:

1. A system that modulates a beam electrons in response to electromagnetic radiation, the system comprising:

an anode positioned at one end of an electron-beam path; and a photocathode positioned at another end of the electron-beam path, the photocathode comprising:

an electrically conductive member configured to conduct current for driving an electron beam through the electron-beam path;

an emitter configured to emit the beam of electrons; and a semiconductive nanomembrane electrically connecting the electrically conductive member to the emitter, wherein the semiconductive nanomembrane has a thickness of less than 200 nanometers and is configured to modulate the electron beam by modulating a current between the electrically conductive member and the emitter in response to electromagnetic radiation impinging upon the semiconductive nanomembrane.

2. The system of claim 1, wherein the emitter comprises carbon nanotubes.

3. The system of claim 1, wherein an impedance of the semiconductive nanomembrane is approximately equal to or greater than an impedance along the electro-beam path from the emitter to the anode.

4. The system of claim 1, wherein the semiconductive nanomembrane comprises silicon and has a thickness of less than 100 nanometers.

5. The system of claim 1, comprising a source of electromagnetic radiation position to illuminate the semiconductive nanomembrane, wherein the source of electromagnetic radiation emits light that changes intensity at radiofrequency or higher frequencies.

6. The system of claim 1, comprising a substrate upon which the electrically conductive member, the semiconductive nanomembrane, and the emitter are disposed, wherein the semiconductive nanomembrane is disposed between the electrically conductive member and the substrate, and wherein the semiconductive nanomembrane is disposed between the emitter and the substrate.

7. The system of claim 6, wherein the anode is disposed on the substrate, and wherein the electron-beam path extends along a surface of the substrate upon which the semiconductive nanomembrane and the anode are disposed.

8. The system of claim 6, wherein the substrate is translucent or transparent to a frequency of electromagnetic radiation that changes the resistance of the semiconductive nanomembrane.

* * * * *